US006497603B1

(12) United States Patent
Magers et al.

(10) Patent No.: US 6,497,603 B1
(45) Date of Patent: Dec. 24, 2002

(54) MUSICAL HULA HOOP

(75) Inventors: Ronald Magers, Gloucester, MA (US); Gerald A. McDonald, Gloucester, MA (US); Michael Risso, Napa, CA (US)

(73) Assignees: M Design, Essex, MA (US); Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/859,056

(22) Filed: May 16, 2001

(51) Int. Cl.[7] ..... A63H 1/00; A63H 1/24

(52) U.S. Cl. ..... 446/242; 446/236; 446/265; 446/484

(58) Field of Search ..... 446/236, 242, 446/265, 266, 297, 484, 485

(56) References Cited

U.S. PATENT DOCUMENTS

| | | | | | |
|---|---|---|---|---|---|
| 4,006,556 | A | * | 2/1977 | Williams | 446/242 |
| 4,380,885 | A | * | 4/1983 | Komagata | 403/383 |
| 4,480,831 | A | | 11/1984 | Muller-Deinhardt | |
| 4,915,666 | A | * | 4/1990 | Maleyko | 446/242 |
| 5,083,964 | A | | 1/1992 | Arad et al. | |
| 5,108,340 | A | * | 4/1992 | Farrow | 446/219 |
| 5,145,443 | A | | 9/1992 | Vaisnys et al. | |
| 5,533,947 | A | | 7/1996 | Tomlinson et al. | |
| 5,823,846 | A | * | 10/1998 | Arriola et al. | 446/236 |
| 5,997,449 | A | * | 12/1999 | Lee | 446/236 |
| 6,036,573 | A | * | 3/2000 | Huang | 446/242 |
| 6,059,632 | A | * | 5/2000 | Sassak | 403/298 |
| 6,265,984 | B1 | * | 7/2001 | Molinaroli | 340/815.4 |

OTHER PUBLICATIONS

FAO Schwarz "FAO Girl Light & Sound Hoop" hula hoop packaging.

* cited by examiner

*Primary Examiner*—Jacob K. Ackun
*Assistant Examiner*—Faye Francis
(74) *Attorney, Agent, or Firm*—Marshall Gerstein & Borun

(57) ABSTRACT

A musical hoop toy may be provided with a hoop structure, a sensing mechanism coupled to the hoop structure and being disposed on an interior side of the hoop structure such that, when the hoop structure is spun around a person's waist, the sensing mechanism will be periodically activated by a portion of the person's waist, an audio speaker coupled to the hoop structure, and a controller operatively coupled to the sensing mechanism and the audio speaker. The controller may include a processor, a memory, and a computer program stored in the memory. The computer program may have a computer program portion that causes a music sequence to be generated and a computer program portion that causes an audio sound effect to be generated in response to each activation of the sensing mechanism.

20 Claims, 3 Drawing Sheets

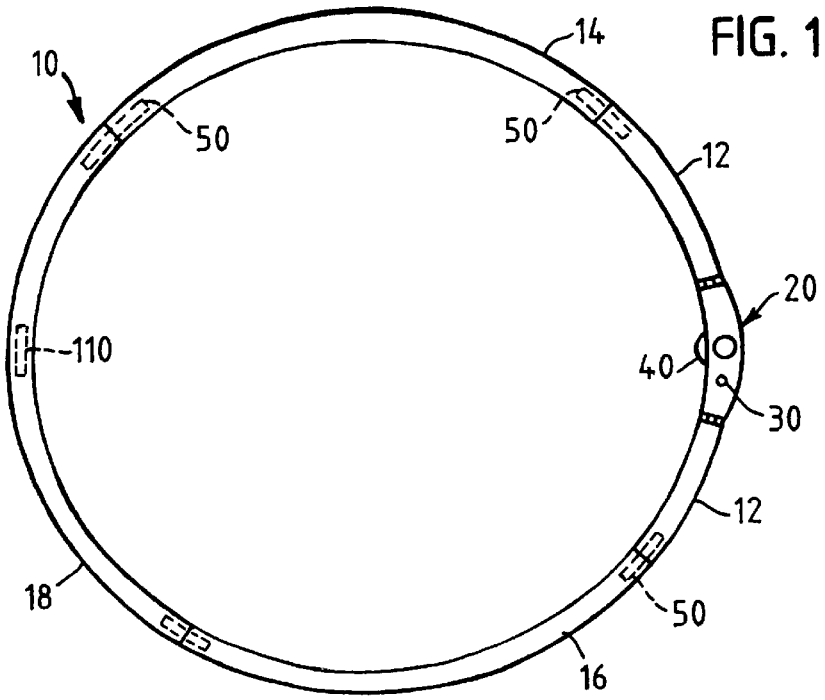
FIG. 1
FIG. 2
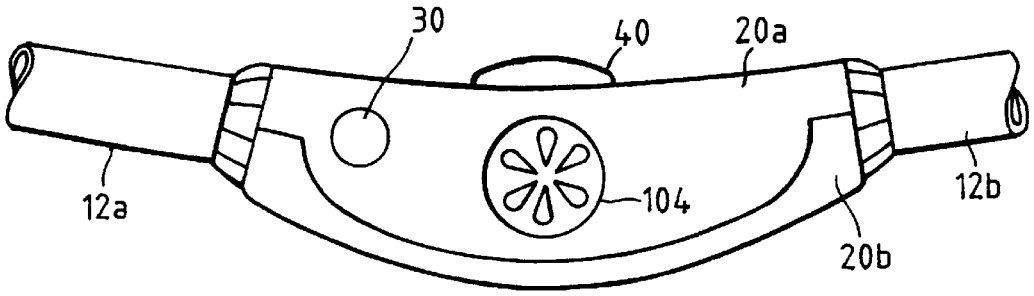
FIG. 3
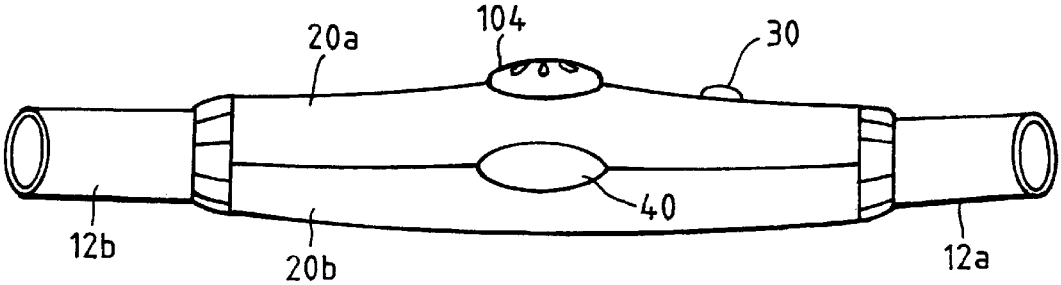

MUSICAL HULA HOOP

BACKGROUND OF THE INVENTION

The present invention is directed to a musical hula hoop, and more particularly to a musical hula hoop that selectively generates music based on use of the hula hoop.

Hula hoops are well-known toys and have been marketed for many years. Various different designs of hula hoops have been made. For example, U.S. Pat. No. 5,083,964 to Arad, et al. discloses a hula hoop having a counter mechanism that counts the number of rotations of the hula hoop when being used. The counter mechanism is operatively coupled to an actuator that causes indexing of the counter mechanism in response to displacement of the actuator mechanism due to contact between the actuator mechanism and the person using the hula hoop.

U.S. Pat. No. 5,108,340 to Farrow discloses a hula hoop having a sound system that generates music and a lighting system. The Farrow patent discloses that the lighting system may include a plurality of light bulbs and a plurality of pressure switches that are positioned in an interior portion of the hula hoop so to make contact with the person using the hula hoop.

U.S. Pat. No. 5,145,443 to Vaisnys, et al. discloses a hula hoop that is provided with a sound-generating system for generating a tone, a steady simple beat, a rhythmic beat, or a tune. The hula hoop is provided with a switch which may be in the form of a motion detector that senses motion of the hula hoop so that the sound generating system only operates when the hula hoop is being used.

SUMMARY OF THE INVENTION

In one aspect, the invention is directed to a musical hoop toy that may include a first hoop section comprising a hollow tube, a second hoop section comprising a hollow tube, a first hoop connector that is capable of joining the second hoop section to the first hoop section, a third hoop section comprising a hollow tube, a second hoop connector that is capable of joining the third hoop section to the second hoop section, a fourth hoop section comprising a hollow tube, and a third hoop connector that is capable of joining the fourth hoop section to the third hoop section. The hoop sections may form at least part of a circular hoop structure having a diameter in the range of about 25 inches to about 40 inches when the hoop sections are joined by the connectors.

The musical hoop toy may also include a housing coupled to one of the hoop sections, one or more batteries disposed in the housing, a counterweight disposed in one of the hoop sections other than the hoop section to which the housing is coupled, a music button associated with the housing, and a contact button associated with the housing and being disposed on an interior side of the toy hoop such that, when the toy hoop sections are connected together and when the toy hoop is spun around a person's waist, the contact button will be periodically activated by contact with a portion of the person's waist.

The musical hoop toy may also include an audio speaker and a controller operatively coupled to the music button, the contact button and the audio speaker. The controller may include a processor, a memory, and a computer program stored in the memory. The computer program may include a computer program portion that causes a music sequence to be started in response to the music button being pressed, the music sequence having a possible duration of at least about three seconds, a computer program portion that causes the time period to be restarted each time the contact button is activated, a computer program portion that causes the music sequence to be terminated if the contact button is not activated before the time period elapses, and a computer program portion that causes an audio sound effect to be generated in response to each activation of the contact button.

In another aspect, the invention is directed to a musical hoop toy that may include a hoop structure having a diameter in the range of between about 25 inches and about 40 inches, a sensing mechanism disposed on an interior side of the hoop toy such that, when the hoop toy is spun around a person's waist, the sensing mechanism will be periodically activated by a portion of the person's waist, an audio speaker, and a controller operatively coupled to the sensing mechanism and the audio speaker. The controller may include a processor, a memory, and a computer program stored in the memory. The computer program may include a computer program portion that causes a music sequence to be started and a computer program portion that causes the music sequence to be terminated if the sensing mechanism is not activated before a given time period elapses.

In another aspect, the invention is directed to a musical hoop toy that may include a hoop structure, a sensing mechanism disposed on an interior side of the hoop toy such that, when the hoop toy is spun around a person's waist, the sensing mechanism will be periodically activated by a portion of the person's waist, an audio speaker, and a controller operatively coupled to the sensing mechanism and the audio speaker. The controller may include a processor, a memory, and a computer program stored in the memory. The computer program may have a computer program portion that causes a music sequence to be generated and a computer program portion that causes an audio sound effect to be generated in response to each activation of the sensing mechanism.

BRIEF DESCRIPTION OF THE DRAWINGS

FIG. 1 is a top view of an embodiment of a musical hula hoop in accordance with the invention;

FIG. 2 is a top view of a portion of the hula hoop of FIG. 1;

FIG. 3 is a side view of the hula hoop portion shown in FIG. 2;

DETAILED DESCRIPTION OF VARIOUS EMBODIMENTS

Figure 4:
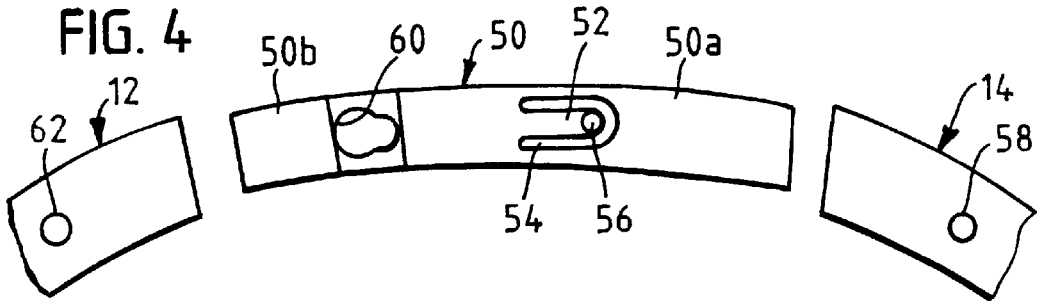
FIG. 4 is a top view of several components of the hula hoop.

FIG. 1 is one embodiment of a musical hula hoop 10 in accordance with the invention. Referring to FIG. 1, the hula hoop 10 may be provided with a first hoop section 12, a second hoop section 14, a third hoop section 16, and a fourth hoop section 18. Each of the hoop sections 12, 14, 16, 18 may comprise an elastically flexible plastic material formed in the shape of a hollow tube. Although four hoop sections 12, 14, 16, 18 are shown, a different number of hoop sections may be used. Alternatively, the hula hoop 10 may be provided with a single piece of tubing or other structure instead of separate hoop sections. When commercially marketed, the hoop sections 12, 14, 16, 18 may be packaged in unassembled form to provide a compact package. When assembled together as shown in FIG. 1, the hoop sections 12, 14, 16, 18 may form a circular hula hoop structure having a diameter that may range from about 25 inches to about 40 inches. For example, the hoop structure may have a diameter of about 30 inches.

Referring to FIGS. 1–3, the hula hoop 10 may be provided with a housing 20 having a hollow interior. The housing 20 may be composed of plastic and may include a first housing section 20*a* and a second housing section 20*b* that is connected to the first housing section 20*a*. To facilitate incorporation of the housing 20, the hoop section 12 may be composed of two hoop sections, a first hoop section 12*a* and a second hoop section 12*b*, each of which may have an end that is permanently connected to one of the sides of the housing 20 in any manner.

A music button 30 may be provided on the housing 20, and a sensing mechanism that may be in the form of a contact button 40 may be disposed on an internal side of the housing 20. When the music button 30 is pressed, a song or audible music sequence may be generated by the hula hoop 10. The contact button 40 may be designed so that it is actuated, such as by being pushed in or depressed, upon the contact button 40 coming into contact with a portion, such as the waist, of a person when the hula hoop 10 is being spun about the waist of the person. The contact button 40 may be used to prolong the play of a music sequence or to generate a sound effect in addition to the music sequence being played, as described below.

Figure 5:
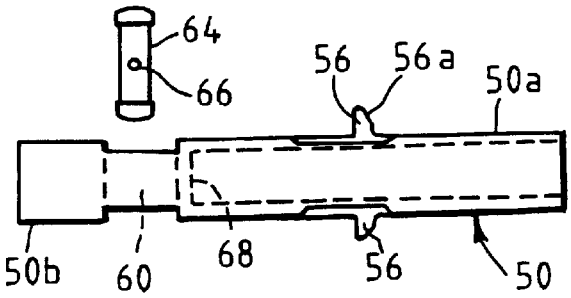
FIG. 5 is a side view of several components of the hula hoop.

Referring to FIGS. 4 and 5, the hula hoop 10 may be provided with a plurality of connectors 50, each of which is designed to join together two of the hoop sections 12, 14, 16, 18. FIG. 4 is a top view of one of the connectors 50 and the end portions of the hoop sections 12, 14, shown with the hoop sections 12, 14 not joined together. The connector 50 may be provided with an arcuate shape to coincide with the circular shape of the hula hoop 10 when completely assembled. The connector 50 may be composed of a relatively rigid piece of plastic and may have a first portion 50*a* generally in the form of a hollow tube (see FIG. 5) and a second portion 50*b* that is not hollow.

The connector 50 may have a pair of retaining members 52, each of which may be formed by a respective U-shaped slot 54 formed in the tubular portion 50*a* of the connector 50. Each retaining member 52 may be provided with a generally spherical retainer 56 that is shaped to fit within a respective one of two holes 58 formed in the end portion of one of the hoop section 14. When formed with the U-shaped slot 54, the retaining members 52 may be flexed inwardly in an elastic manner so that, when the tubular portion 50*a* of the connector 50 is inserted into the hoop sections 14, the circular wall of the hoop section 14 will force the retainers 56 inwardly until the retainers 56 become aligned with the holes 58, at which point the retainers 56 will move outwardly so that they pass through the holes 58 and join the connector 50 to the hoop section 14. Each of the generally spherically shaped retainers may have a flat, angled portion 56*a* to facilitate removal of the connector 50 from the hoop section 14 (the connector 50 may be removed by pressing the retainers 56 inwardly and simultaneously pulling the connector 50 away from the end of the hoop section 14).

The connector portion 50*b* of each connector 50 may be permanently connected within an end of one of the hoop sections 12, 14, 16, 18. The connector portion 50*b* may have an aperture 60 formed therein, which may have a shape formed by a pair of overlapping circular bores as shown in FIG. 4. The connector portion 50*b* may be permanently anchored within the hoop section 12 in the following manner. First, the connector portion 50*b* may be inserted into the end of the hoop section 12 so that the aperture 60 is aligned with a pair of holes 62 formed in the hoop section 12.

With the aperture 60 aligned with the holes 62, a rod-shaped member 64 may be inserted through one of the holes 62 and through the aperture 60, with the rod-shaped member 64 being oriented so that a screw hole 66 is oriented parallel to the longitudinal axis of the connector 50. When so positioned, the rod-shaped member 64 will pass through the aperture 60 in the connector 50 and each end of the rod-shaped member 64 will be positioned within one of the two holes 62 formed in the hoop section 12, so that the rod-shaped member 64 will act as an anchor member to secure the connector 50 to the hoop section 12. With the rod-shaped member 64 in that orientation, a screw (not shown) may be inserted into the hollow center of the connector portion 50*a* and screwed through a wall 68 (which may have a screw hole formed therein) into the screw hole 66 in the anchor member 64, thus securely connecting the anchor member 64 to the connector 50. The assembly procedure just described may be done during manufacture of and prior to marketing of the hula hoop 10 so that the purchaser need not perform such assembly.

Although the connectors 50 are described above in detail, other types of connectors could be utilized. For example, instead of using connectors that are not integrally formed with the hoop sections 12, 14, 16, 18, connectors that are molded or otherwise integrally formed with the hoop sections could be utilized, as well as many other types of connectors.

Figure 6:
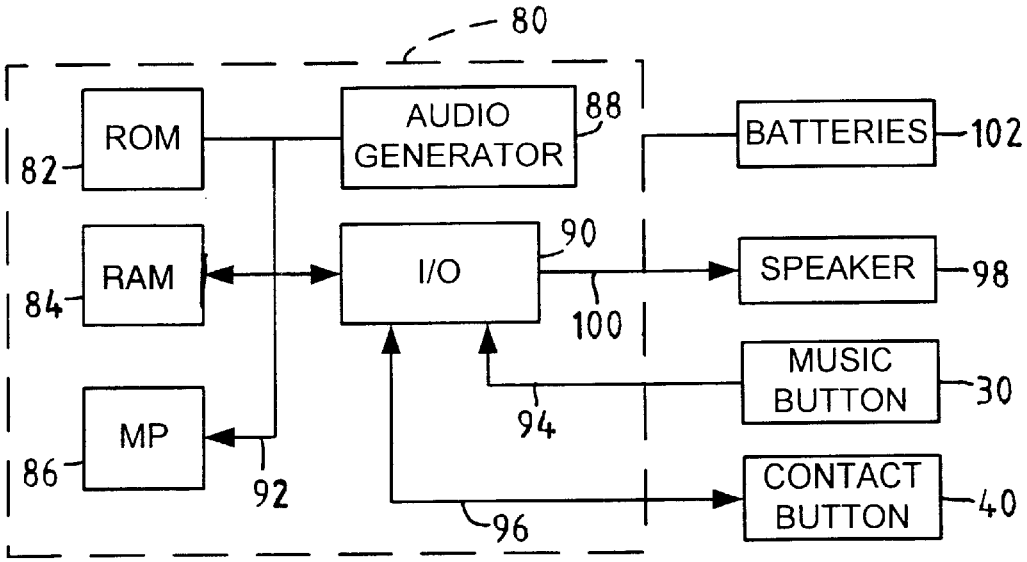
FIG. 6 is a block diagram of a number of components that may be incorporated in the hula hoop.

FIG. 6 is a block diagram of various components that may be incorporated into the hula hoop 10, such as by being disposed within the housing 20, that may control the generation of music. Referring to FIG. 6, the hula hoop 10 may be provided with a controller 80, which may include a read-only memory (ROM) 82, a random-access memory (RAM) 84, a microprocessor (MP) 86, an audio generator 88, and an input/output (I/O) circuit 90, all of which may be interconnected via a communication link, such as an address/data bus 92. The I/O circuit 90 may be coupled to the music button 30 via a signal line 94 and to the contact button 40 via a signal line 96. The I/O circuit 90 may be coupled to drive an audio speaker 98 via a line 100, and one or more batteries 102 may be incorporated in the housing 20 to provide power to the controller 80.

It should be appreciated that the controller 80 may be a single-chip microcontroller, which may or may not include the audio generator 88. The audio generator 88 may be any type of integrated circuit or device capable of generating music sequences. For example, the audio generator 88 may be provided in the form of an AM or FM receiver that receives broadcast music. Although the I/O circuit 90 is shown as a single block, it should be appreciated that the I/O circuit 90 could include a number of different types of I/O circuits and a drive circuit for driving the speaker 98. The passage of sound from the speaker 98 through the housing 20 may be facilitated by a porous or sound-permeable member or speaker cover 104 (see FIGS. 2 and 3). If the components of FIG. 6 are incorporated into the housing 20, the hula hoop 10 may become unbalanced. In that case, a counterweight 110 (FIG. 1) may be incorporated into the hula hoop 10 at a location that is approximately diametrically opposed from the housing 20. That is, the counterweight 110, the center of gravity of the housing 20, and the center of the circular hula hoop 10 may lie substantially in a straight line.

Figure 7:
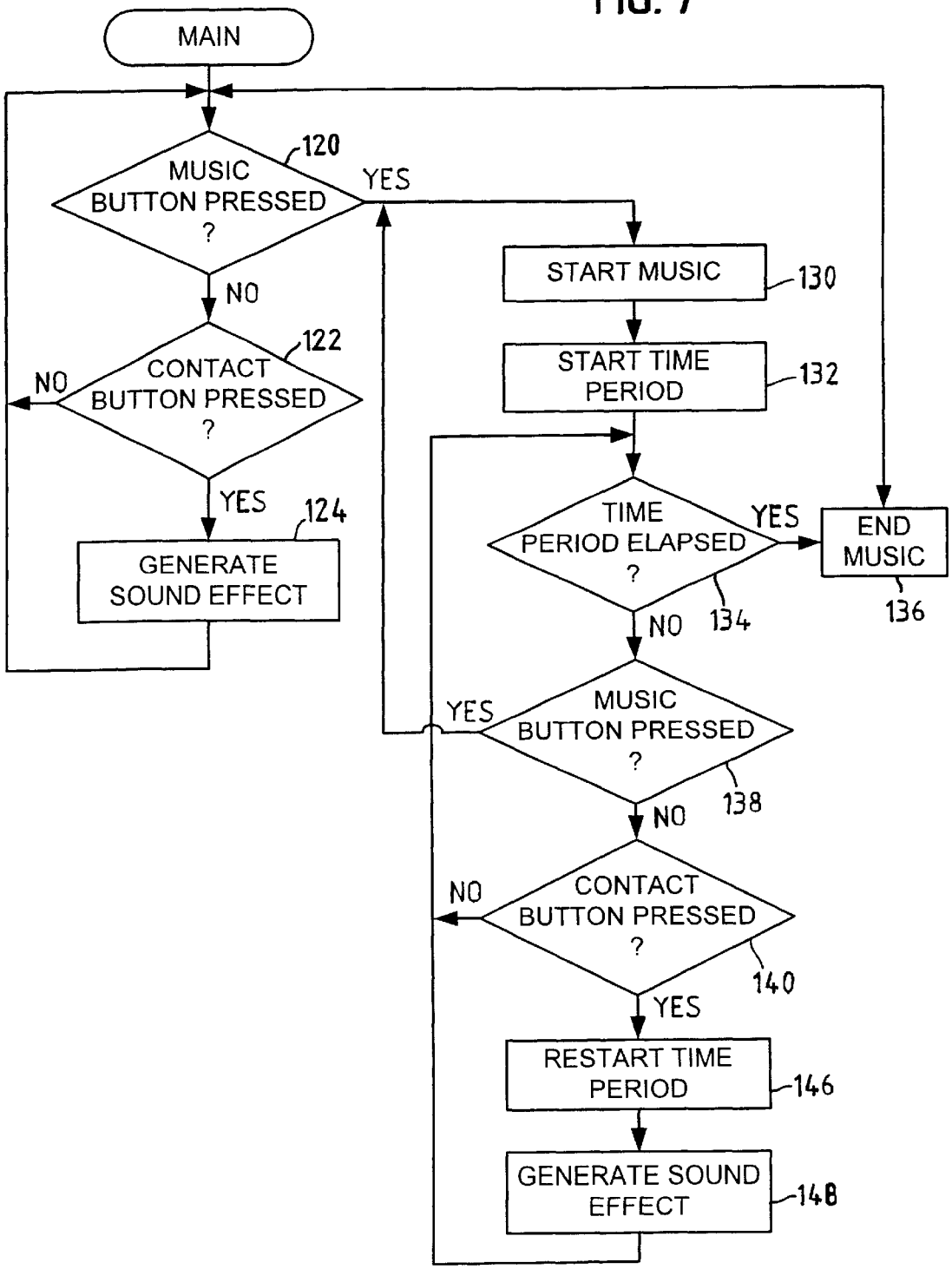
FIG. 7 is a flowchart of a computer program that may be used to control the operation of the hula hoop.

A computer program may be stored in the memory, such as the ROM 82, of the controller 80 and executed by the microprocessor 86 to control the generation of music. FIG. 7 is a flowchart of the actions that may be caused by various portions of the computer program, with each of the computer program portions comprising one or more computer program instructions. Referring to FIG. 7, at block 120, if the music button 30 has not been pressed, the controller 80 may check to determine whether the contact button 40 has been pressed (either by a person's hand or by using the hula hoop 10) at block 122. If the contact button 40 has been pressed, a sound effect may be generated at block 124 by causing the audio generator 88 to generate an electronic sound effect, which is converted into an audible sound effect via the speaker 98. As should be apparent to those with ordinary skill in the art, it should be appreciated that pressing either the music button 30 or the contact button 40 could cause an interrupt service routine to automatically be performed.

If the music button was pressed as determined at block 120, the controller 80 may cause a music sequence to be started at block 130. The music sequence may be stored in electronic form, as music data, in the audio generator 88. A number of different music sequences may be stored, and a different music sequence may be generated each time the music button 30 is pressed. The music sequence may have a given duration or time period, which may be at least as long as the time required for one full revolution of the hula hoop 10 when being spun about a person's waist. Such a minimum duration could be about two or about three seconds, for example. Alternatively, the time duration may be longer, such as about ten seconds or about fifteen seconds. At block 132, the controller 80 causes a time period to commence, which time period may be shorter than the duration of the music sequence that was started at block 130. The time period may be started with an electronic clock or timer incorporated in the controller 80, for example.

At block 134, if the time period started at block 132 has elapsed, at block 136 the controller 80 may cause the music sequence started at block 130 to terminate. If the time period has not elapsed as determined at block 134, at block 138 the controller 80 may check to determine whether the music button 30 was pressed, which would likely be the case where the user of the hula hoop 10 wanted to play a different music sequence. In that case, at block 130 the controller 80 would cause another one of the music sequences stored in the audio generator 88 to be commenced.

If the music button was not pressed as determined at block 138, at block 140 the controller 80 may check to determine whether the contact button 40 was pressed, which would typically occur due to physical contact between the user's waist and the contact button 40 when the user was using the hula hoop 10. If the contact button 40 was pressed, at block 146 the time period started at block 132 may be restarted. For example, if one second of a ten-second time period had elapsed just prior to block 146, block 146 would cause the ten-second time period to be restarted, for example, by setting a timer or clock back to zero, so that it would take a full ten seconds for the time period to elapse, instead of only the nine remaining seconds of the original time period.

At block 148, a sound effect may be generated. The sound effect may be stored in electronic form in the audio generator 88 and may be of relatively short duration, such as about one second or less in duration. The audio generator 88 may store data representing multiple sound effects, and each of the sound effects may be associated with a particular music sequence (assuming the audio generator 88 stores multiple music sequences). Thus, if a particular music sequence was initiated at block 130, at block 148 the sound effect associated with that particular music sequence could be generated via the speaker 98.

To use the musical hula hoop 10, a user may place the hula hoop 10 around his or her waist, press the music button 30 (which will cause a music sequence to commence at block 130 as described above), and then begin to spin the hula hoop 10 around his or her waist. As long as the hula hoop 10 continues to spin, periodic contact will be made between the user's waist and the contact button 40, thus causing the contact button 40 to be periodically depressed or activated. As long as the time period started at block 132 is longer than the time between successive activations of the contact button 140, the music sequence will continue to play. If the user fails to keep the hula hoop 10 spinning, the contact button 40 will not be pressed and the music will eventually stop. If the user is using the hoop 10 and wishes to play another music sequence, the user may stop using the hoop 10, press the music button 30, and start to use the hoop 10 again.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A musical hoop toy, comprising:

a first hoop section comprising a hollow tube;

a second hoop section comprising a hollow tube;

a first hoop connector that is capable of joining said second hoop section to said first hoop section;

a third hoop section comprising a hollow tube;

a second hoop connector that is capable of joining said third hoop section to said second hoop section;

a fourth hoop section comprising a hollow tube; and a third hoop connector that is capable of joining said fourth hoop section to said third hoop section, said hoop sections forming at least part of a circular hoop structure having a diameter in the range of about 25 inches to about 40 inches when said hoop sections are joined by said connectors;

a housing coupled to one of said hoop sections;

a battery disposed in said housing;

a counterweight disposed in one of said hoop sections other than said hoop section to which said housing is coupled;

a music button;

a contact button disposed such that, when said hoop sections are connected together and when said hoop toy is spun around a person's waist, said contact button will be periodically activated by contact with a portion of the person's waist;

an audio speaker; and a controller operatively coupled to said music button, said contact button and said audio speaker, said controller comprising a processor, a memory, and a computer program stored in said memory, said computer program comprising:

a computer program portion that causes a music sequence to be started in response to said music button being pressed, said music sequence having a possible duration of at least about three seconds;

a computer program portion that causes said time period to be restarted each time said contact button is activated;

a computer program portion that causes said music sequence to be terminated if said contact button is not activated before said time period elapses; and a computer program portion that causes an audio sound effect to be generated in response to each activation of said contact button.

2. A musical hoop toy as defined in claim 1 wherein said hoop connectors are not integrally formed with said hoop sections.

3. A musical hoop toy as defined in claim 1 wherein said computer program comprises a computer program portion that causes a second music sequence to be generated in response to said music button being pressed a second time.

4. A musical hoop toy, comprising:

a plurality of hoop sections;

a plurality of hoop connectors that are capable of joining said hoop sections together to form a circular hoop structure;

a housing coupled to one of said hoop sections;

a contact button disposed such that, when said hoop sections are connected together and when said hoop toy is spun around a person's waist, said contact button will be periodically activated by a portion of the person's waist;

an audio speaker; and a controller operatively coupled to said contact button and said audio speaker, said controller comprising a processor, a memory, and a computer program stored in said memory, said computer program comprising:

a computer program portion that causes a music sequence to be started; and a computer program portion that causes said music sequence to be terminated if said contact button is not activated before a given time period elapses.

5. A musical hoop toy as defined in claim 4 wherein said computer program comprises a computer program portion that causes said time period to be restarted each time said contact button is activated.

6. A musical hoop toy as defined in claim 4 wherein said computer program comprises a computer program portion that causes a second music sequence to be generated in response to a music button being pressed.

7. A musical hoop toy as defined in claim 4 wherein said computer program comprises a computer program portion that causes an audio sound effect to be generated in response to each activation of said contact button.

8. A musical hoop toy, comprising:

a hoop structure having a diameter in the range of between about 25 inches and about 40 inches;

a sensing mechanism coupled disposed on an interior side of said hoop toy such that, when said hoop toy is spun around a person's waist, said sensing mechanism will be periodically activated by a portion of the person's waist;

an audio speaker; and a controller operatively coupled to said sensing mechanism and said audio speaker, said controller comprising a processor, a memory, and a computer program stored in said memory, said computer program comprising:

a computer program portion that causes a music sequence to be started; and a computer program portion that causes said music sequence to be terminated if said sensing mechanism is not activated before a given time period elapses.

9. A musical hoop toy as defined in claim 8 wherein said computer program comprises a computer program portion that causes said time period to be restarted each time said sensing mechanism is activated.

10. A musical hoop toy as defined in claim 8 wherein said computer program comprises a computer program portion that causes a second music sequence to be generated in response to a music button being pressed.

11. A musical hoop toy as defined in claim 8 wherein said computer program comprises a computer program portion that causes an audio sound effect to be generated in response to each activation of said sensing mechanism.

12. A musical hoop toy, comprising:

a plurality of hoop sections;

a plurality of hoop connectors that are capable of joining said hoop sections together to form a hoop structure;

a sensing mechanism disposed on an interior side of said hoop toy such that, when said hoop toy is spun around a person's waist, said sensing mechanism will be periodically activated by a portion of the person's waist;

an audio speaker; and a controller operatively coupled to said sensing mechanism and said audio speaker, said controller comprising a processor, a memory, and a computer program stored in said memory, said computer program comprising:

a computer program portion that causes a music sequence to be started; and a computer program portion that causes said music sequence to be terminated if said sensing mechanism is not activated before a given time period elapses.

13. A musical hoop toy as defined in claim 12 wherein said computer program comprises a computer program portion that causes said time period to be restarted each time said sensing mechanism is activated.

14. A musical hoop toy as defined in claim 12 wherein said computer program comprises a computer program portion that causes a second music sequence to be generated in response to a music button being pressed.

15. A musical hoop toy as defined in claim 12 wherein said computer program comprises a computer program portion that causes an audio sound effect to be generated in response to each activation of said sensing mechanism.

16. A musical hoop toy, comprising:

a hoop structure having a diameter in the range of between about 25 inches and about 40 inches;

a sensing mechanism disposed such that, when said hoop toy is spun around a person's waist, said sensing mechanism will be periodically activated by a portion of the person's waist;

an audio speaker; and a controller operatively coupled to said sensing mechanism and said audio speaker, said controller comprising a processor, a memory, and a computer program stored in said memory, said computer program comprising:

a computer program portion that causes a music sequence to be generated; and a computer program portion that causes an audio sound effect to be generated in response to each activation of said sensing mechanism.

17. A musical hoop toy as defined in claim 16 wherein said computer program comprises a computer program portion that causes a second music sequence to be generated in response to a music button being pressed.

18. A musical hoop toy, comprising:

a plurality of hoop sections;

a plurality of hoop connectors that are capable of joining said hoop sections together to form a hoop structure;

a sensing mechanism disposed such that, when said hoop sections are joined together and when said hoop toy is spun around a person's waist, said sensing mechanism will be periodically activated by a portion of the person's waist;

an audio speaker; and a controller operatively coupled to said sensing mechanism and said audio speaker, said controller comprising a processor, a memory, and a computer program stored in said memory, said computer program comprising:

a computer program portion that causes a music sequence to be generated; and a computer program portion that causes an audio sound effect to be generated in response to each activation of said sensing mechanism.

19. A musical hoop toy as defined in claim 18 wherein said hoop connectors are not integrally formed with said hoop sections.

20. A musical hoop toy as defined in claim 18 wherein said computer program comprises a computer program portion that causes a second music sequence to be generated in response to a music button being pressed.

* * * * *